United States Patent [19]

Matthews et al.

[11] Patent Number: 4,461,678

[45] Date of Patent: Jul. 24, 1984

[54] JET PUMP

[75] Inventors: Robert B. Matthews, Hampshire; Peter J. Taylor, Hampshire; Keith J. Dallimore, Southampton, England

[73] Assignee: Plessey Overseas Limited, Ilford, England

[21] Appl. No.: 392,132

[22] Filed: Jun. 25, 1982

[30] Foreign Application Priority Data

Jun. 26, 1981 [GB] United Kingdom ..... 8119774

[51] Int. Cl.[3] ..... C25D 1/02

[52] U.S. Cl. ..... 204/9

[58] Field of Search ..... 204/3, 4, 9

[56] References Cited

U.S. PATENT DOCUMENTS

| | | | |
|---|---|---|---|
| 2,793,989 | 5/1957 | Goodman | 204/9 |
| 3,487,539 | 1/1970 | Dugan | 204/9 |
| 4,255,237 | 3/1981 | Obert | 204/9 |

FOREIGN PATENT DOCUMENTS

| | | | |
|---|---|---|---|
| 2550952 | 5/1977 | Fed. Rep. of Germany | 204/9 |

*Primary Examiner*—Thomas Tufariello

*Attorney, Agent, or Firm*—Fleit, Jacobson, Cohn & Price

[57] ABSTRACT

A jet pump having a diffuser, a mixing section and a nozzle produced by electroforming onto at least one highly polished mandrel, whereby the diffuser, mixing section and nozzle have a surface finish of substantially the same quality as the mandrel.

6 Claims, 10 Drawing Figures

JET PUMP

This invention relates to a jet pump. This invention also relates to a low pressure fuel system employing the jet pump.

Jet pumps are well known and they are effective to convert the potential energy of a fluid being pumped into kinetic energy.

It is an aim of the present invention to provide a jet pump having an improved efficiency compared with known jet pumps of a substantially similar size.

Accordingly, this invention provides a jet pump having a diffuser and a mixing section produced by electroforming onto at least one highly polished mandrel, whereby the diffuser and the mixing section have a surface finish of substantially the same quality as the mandrel.

Preferably, the jet pump also has a nozzle which is produced by electroforming onto the at least one highly polished mandrel, whereby the nozzle has a surface finish of substantially the same quality as the mandrel.

It has been surprisingly established that if the diffuser and the mixing section of the jet pump are provided with the surface finish that is substantially the same as the highly polished surface finish of the mandrel, the efficiency of the pump is greatly increased. For example, if the diffuser, the mixing section and the nozzle are all provided with the surface finish, an efficiency of 38% may be achieved compared with an efficiency of 24% obtained from a known comparably sized good commercially produced jet pump. The required surface finish required may be likened to a mirror finish or a highly polished finish.

The required surface finish is obtained by electroforming as stated above. The electroforming is the electrodeposition of a metal in a relatively even form to provide the desired shape. The temperature and current employed in the electroforming vary with the particular metal being electrodeposited. By way of example, it is mentioned that the deposited metal may be nickel, chromium, copper, cobalt or a variety of alloys. Generally, the more complex shape that the metal is to be electrodeposited into, then the slower is the electrodeposition process in order to give the metal sufficient time to evenly deposit.

Usually, several mandrels will be employed and these mandrels are advantageously interlocking mandrels. The highly polished mandrels are advantageously made to be re-usable. The mandrels may be made from various materials such for example as stainless steel. When stainless steel is employed, the stainless steel is preferably that conforming to Specification S80.

The mandrel or mandrels are preferably coated with an electrically conducting release agent such for example as colloidal graphite. The mandrel or mandrels can then be easily removed from the electroformed jet pump.

As indicated above, the present invention also provides a low pressure fuel system containing the jet pump.

Embodiments of the invention will now be described solely by way of example and with reference to the accompanying drawings in which.

Figure 2:
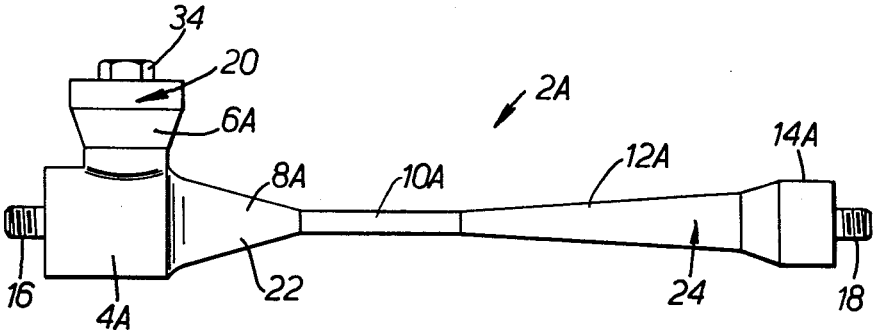
FIG. 2 shows three assembled mandrels for use in electroforming the jet pump of FIG. 1.
Figure 3:
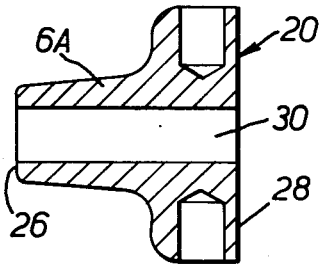
Figure 4:
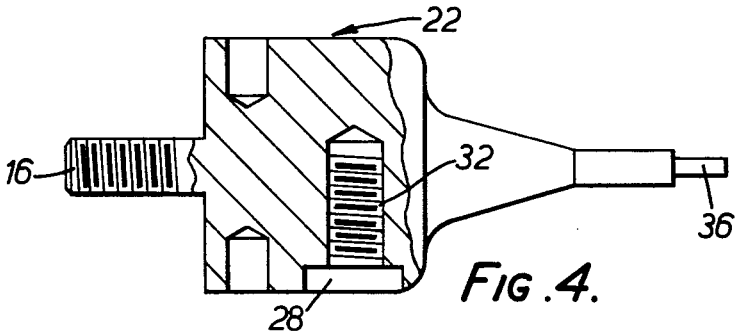
Figure 5:
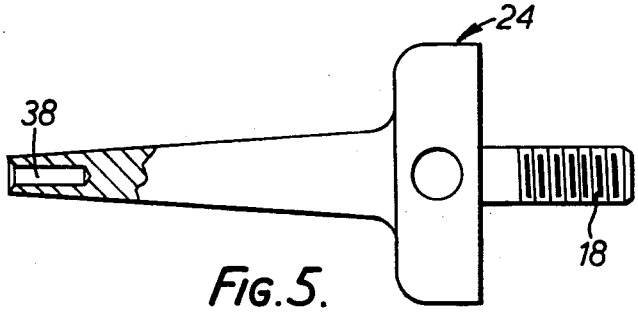
Figure 6:
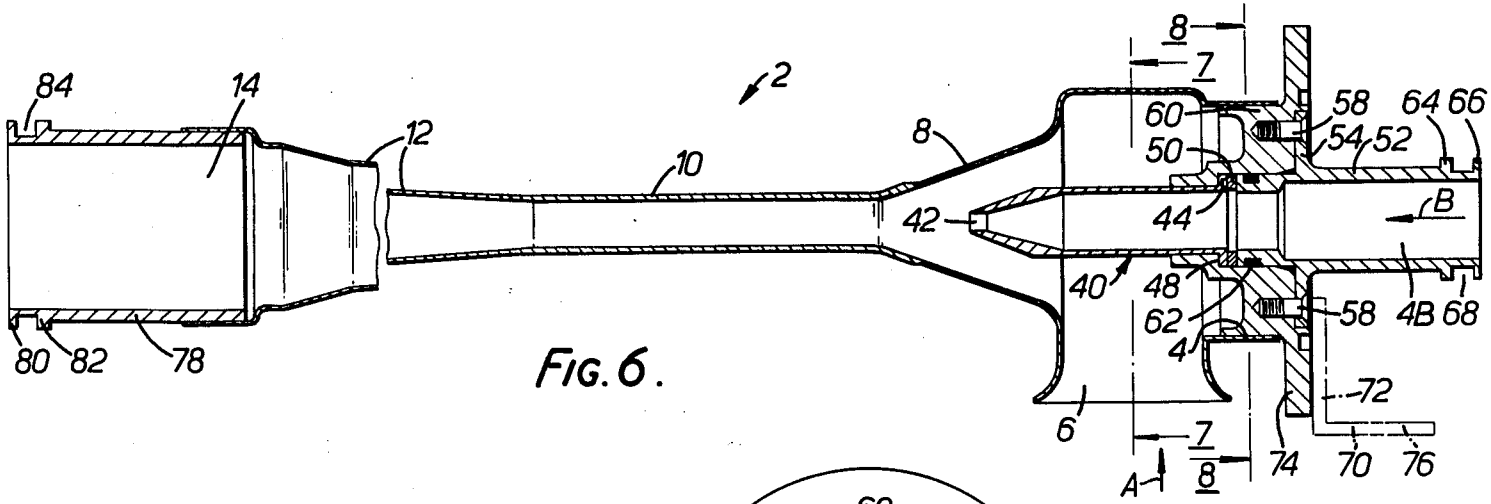
Figure 8:
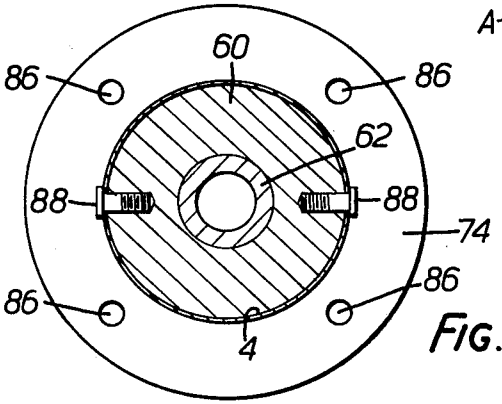
Figure 7:
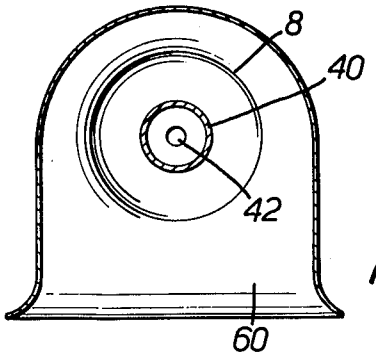
Figure 9:
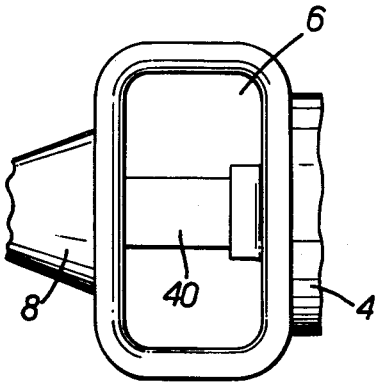

FIGS. 3, 4 and 5 each show one of the three mandrels used in FIG. 2;

FIG. 6 is a longitudinal section showing a second electroformed jet pump;

FIG. 7 is a section on the line 7—7 shown in FIG. 6;

FIG. 8 is a section on the line 8—8 shown in FIG. 6;

FIG. 9 is a scrap view on the arrow A shown in FIG. 6; and

Figure 10:
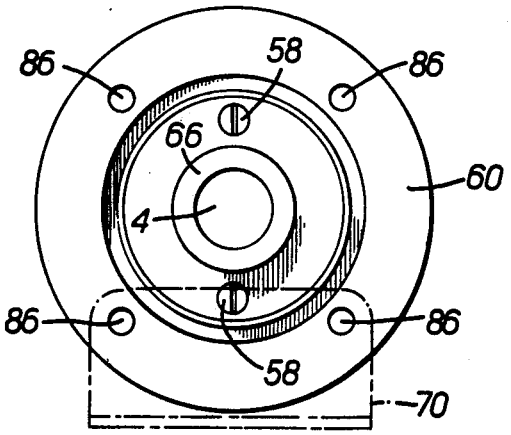

FIG. 10 is a view on the arrow B shown in FIG. 6.

Figure 1:
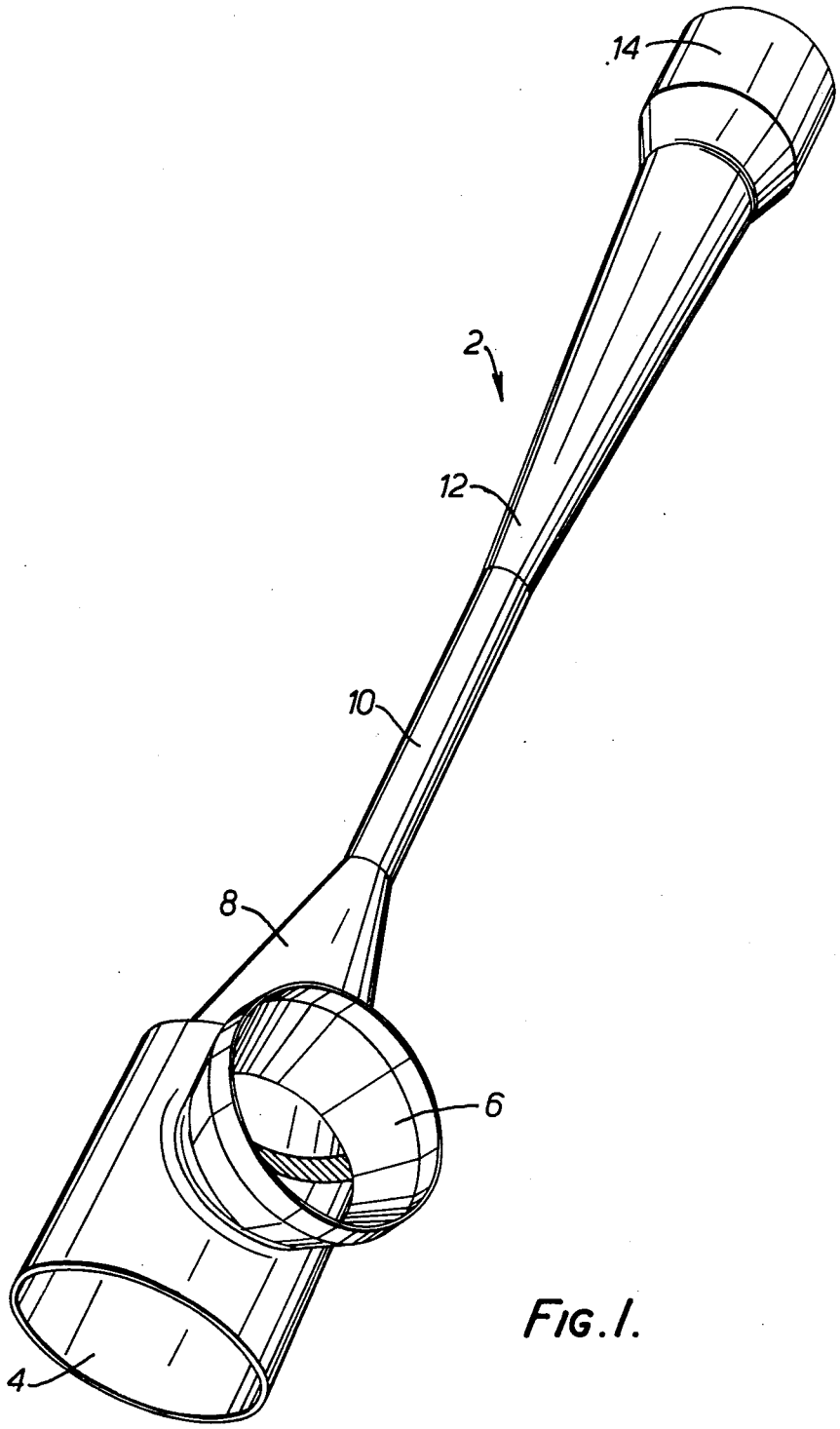
FIG. 1 is a perspective view showing the external profile of a first electroformed jet pump.

Referring to FIG. 1, there is shown the external profile of a first jet pump 2 for an aircraft. The jet pump 2 has an inlet 4 for receiving a high pressure motive flow of fuel. The fuel may be pumped from a tank, for example a main aircraft tank. The jet pump 2 is also provided with a suction inlet 6. The fuel passing through the inlet 4 sucks fuel at low pressure from a tank into the suction inlet 6, so that the flow through the inlet 6 is an induced flow. The suction caused by the high pressure motive fuel flow through the inlet 4 also extends in an inlet cone of the jet pump 2 so that the induced flow passing through the inlet 6 is further sucked along the inlet cone 8.

The fuel from the inlet cone 8 passes to a mixing section in the form of a mixing tube 10 which is in communication with the inlet cone 8. The fuel flows through the inlets 4 and 6 mix in the mixing tube 10. The mixed fuel then passes to a diffuser 12 which is substantially conical as shown and which leads to an outlet 14. A motive flow of fuel passes through the outlet 14.

The jet pump 2 generally illustrated in FIG. 1 may give an efficiency of 38% which is very good. The jet pump 2 may be used in various aircraft applications and it may be especially effective for pumping fuel which has been treated with an anti-misting additive. Thus, the jet pump 2 may be especially effective in pumping anti-misting kerosene.

Referring now to FIG. 2, there are shown three assembled mandrels 20, 22, 24 that are used for electroforming the jet pump 2 of FIG. 1. In FIG. 2 parts that will be adjacent similar parts in FIG. 1 have been given the same reference number but followed by the letter "A". A ready comparison can thus be made between FIGS. 1 and 2. In FIG. 2, it will be noted that the part 4A for forming the inlet 4 has a threaded stub 16 to receive an appropriate connection (not shown). The part 14A for forming the outlet 14 is similarly provided with a threaded stub 18.

Referring now to FIGS. 3, 4 and 5, FIG. 3 shows the mandrel 20, FIG. 4 shows the mandrel 22 and FIG. 5 shows the mandrel 24. FIG. 3 shows that the mandrel 20 has an end 26 which fits in a recess 28 in the mandrel 22 of FIG. 4. The mandrel 20 is provided with a bore 30 and the mandrel 22 is provided with an internally threaded bore 32. When the end 26 is in the recess 28, a bolt 34 (see FIG. 2) can be passed through the bore 30 and screwed into the bore 32 to retain the mandrels 20, 22 together.

The mandrel 22 shown in FIG. 4 is also provided with a spigot 36. This spigot 36 engages in a recess 38 in the mandrel 24 shown in FIG. 5.

When the mandrels shown in FIGS. 3, 4 and 5 are assembled together as shown in FIG. 2, it will be apparent that the assembled arrangement shown in FIG. 2 is of the general shape required to receive electrodeposited nickel or other metal to form the jet pump 2 shown in FIG. 1. The mandrels shown in FIGS. 3, 4 and 5 are made of stainless steel to Specification S80 and they are highly polished and reusable. After the electroforming, the mandrels are removed from the jet pump 2. This removal is facilitated by coating the mandrels, prior to the electrodeposition, with an electrically conducting release agent such for example as colloidal graphite. The electro-formed jet pump 2 will have a highly polished internal surface, which is particularly required for the diffuser 12 and the mixing tube 10. The highly polished surfaces for the jet pump 2 may be likened to mirror finishes.

For simplicity of illustration, the jet pump 2 shown in FIG. 1 does not illustrate the nozzle of the jet pump. Reference will now be made to FIGS. 6 to 10 which show a second electroformed jet pump 2 in which similar parts as in FIG. 1 have been given the same reference number and their precise construction and operation will not again be given. In FIGS. 6–10, the nozzle of the jet pump 2 is also shown.

In FIGS. 6–10, a nozzle 40 is shown and this nozzle 40 is electroformed on a mandrel (not shown) in the same general manner as the other parts of the jet pump 2. The nozzle 40 terminates in the inlet cone 8 and the high pressure fuel leaves the nozzle 40 through a nozzle orifice 42. It is this high pressure fuel leaving the nozzle orifice 42 that causes the required suction in the inlet 6 and the inlet cone 8 for the induced fuel flow.

The nozzle 40 has a flange 44 which seats against a shoulder 48 as shown to secure the nozzle 40 in position.

A packing washer 50 locates against the flange 44 and also against a tubular member 52 which contains an inlet 4B. The tubular member 52 is provided with a flange 54 which is provided with apertures 56 for receiving screws 58. The screws 58 secure the tubular member 52 to a body portion 60 of the jet pump 2. The inner end of the tubular member 52 is provided with an O-ring seal 62 for effecting a seal between the inner end of the tubular member 52 and the body portion 60. The body portion 60 fits as shown inside the inlet 4 of the jet pump 2 which is illustrated in FIG. 1. The high pressure motive fuel flow is then obviously through the inlet 4B in the tubular member 52 shown in FIG. 6.

The outer end of the tubular member 52 is provided with a pair of flanges 64, 66 and these flanges define between them an annular groove 68. The flanges 64, 66 and the annular groove 68 form a pipe connection for receving a pipe (not shown) for enabling fuel to be passed from a tank to the inlet 4B. A seal (not shown) can be located in the annular groove 68.

A right angled bracket 70 may be provided. One arm 72 of the bracket 70 is secured to a flange 74 extending from the body portion 60 of the jet pump 2. The other arm 76 of the bracket 70 is available for securing the jet pump 2 in a desired position.

The end of the jet pump 2 including the outlet 14 as shown in FIG. 1 is secured over a short tubular member 78. The tubular member 78 can be secured in position by being stuck or appropriately welded. The tubular member 78 is provided with a pair of flanges 80, 82 which define between them an annular groove 84. The flanges 80, 82 and the annular groove 84 form a connection means for enabling a pipe (not shown) to be connected to the tubular member 78 to enable fuel from the jet pump 2 to be directed where desired, via the outlet 14 and the tubular member 78. An O-ring seal (not shown) may be located in the groove 84.

FIG. 8 shows that the flange 74 is provided with four apertures 86 for enabling the jet pump 2 to be bolted to a desired position, via these apertures 86, if desired. FIG. 8 also illustrates a pair of screws 88 securing the part of the jet pump 2 defining the inlet 4 to the body portion 60.

FIG. 9 is a view on the arrow A shown in FIG. 6 and particularly illustrates the rectangular shape of the mouth of the inlet 6. FIG. 7 shows a section of the inlet 6 and so further illustrates the shape of the inlet 6.

It is to be appreciated that the embodiments of the invention described above with reference to the accompanying drawings have been given by way of example only and that modifications may be effected. Thus, for example, the electrodeposited metal may be chromium, copper, cobalt or an alloy. Also, although the jet pumps 2 will usually be used for pumping fuel, they may be used for pumping other liquids in, for example, industrial applications. The size of the jet pumps will vary depending on their intended specific use.

We claim:

1. A jet pump having a diffuser, a mixing section, and an inlet arranged perpendicularly to the diffuser, the jet pump having an inner, smooth surface of substantially the same quality as the mandrel, the jet pump produced by the process comprising:

providing a plurality of forming mandrels including a diffuser and mixing section mandrel having a first axis and an inlet mandrel having a second axis, said mandrels defining the interior surface of said jet pump, at least one of said mandrels adapted for releasable attachment to the other of said mandrels;

interconnecting said mandrels to define a mandrel assembly, said inlet mandrel attached to said diffuser and mixing section mandrel, said second axis extending transversely relative to said first axis;

depositing metal to a desired thickness on said mandrel assembly by electrodeposition to provide a substantially even metallic coating defining a jet pump body having a hollow diffuser and mixing section and a hollow, integral inlet section having its axis transverse to the axis of the diffuser and mixing section; and disconnecting said mandrels from each other; and removing said mandrels from the jet pump body for subsequent re-use, whereby a jet pump having a smooth inner surface is provided.

2. A jet pump according to claim 1 including a nozzle produced by electrodeposition of metal on a nozzle mandrel and having an inner, smooth surface finish of substantially the same quality as the mandrel.

3. A jet pump according to claim 1 in which each mandrel is coated with an electrically conducting release agent.

4. A jet pump according to claim 3 in which the electrically conducting release agent is colloidal graphite.

5. A low pressure fuel system including a jet pump having a diffuser, a mixing section, and an inlet arranged perpendicularly to the diffuser, the jet pump having an inner, smooth surface of substantially the same quality as the mandrel, said jet pump produced by the process comprising:

providing a plurality of forming mandrels including a diffuser and mixing section mandrel having a first axis and an inlet mandrel having a second axis, said mandrels defining the interior surface of said jet pump, at least one of said mandrels adapted for releasable attachment to the other of said mandrels;

interconnecting said mandrels to define a mandrel assembly, said inlet mandrel attached to said diffuser and mixing section mandrel, said second axis extending transversely relative to said first axis;

depositing metal to a desired thickness on said mandrel assembly by electrodeposition to provide a substantially even metallic coating defining a jet pump body having a hollow diffuser and mixing section and a hollow, integral inlet section having its axis transverse to the axis of the diffuser and mixing section; and disconnecting said mandrels from each other; and removing said mandrels from the jet pump body for subsequent re-use.

6. A low pressure fuel system according to claim 5 in which the jet pump includes a nozzle produced by electrodeposition of metal on a nozzle mandrel and having an inner, smooth surface finish of substantially the same quality as the mandrel.

* * * * *